United States Patent [19]

Morris

[11] 4,354,818

[45] Oct. 19, 1982

[54] MOULDING APPARATUS FOR COMPACTING POWDERED MATERIALS

[76] Inventor: Kenneth J. Morris, 28 Berrisford Close, Market Drayton, Shropshire, England, TF9 1LG

[21] Appl. No.: 251,291

[22] Filed: Apr. 6, 1981

[30] Foreign Application Priority Data

Apr. 11, 1980 [GB] United Kingdom ..... 8012105

[51] Int. Cl.[3] ..... B30B 5/02

[52] U.S. Cl. ..... 425/405 H; 425/411

[58] Field of Search ..... 425/405 H, 410, 409, 425/411

[56] References Cited

U.S. PATENT DOCUMENTS

| | | | |
|---|---|---|---|
| 3,140,513 | 7/1964 | Campbell et al. | 425/411 X |
| 3,239,591 | 3/1966 | Wendt | 425/405 H X |
| 3,591,903 | 7/1971 | Bowles | 425/405 H X |
| 3,618,164 | 11/1971 | Rietmann | 425/405 H X |
| 3,677,674 | 7/1972 | Bowles | 425/405 H X |
| 3,730,666 | 5/1973 | Bowles | 425/405 H |
| 3,761,574 | 9/1973 | Rietmann | 425/405 H |
| 3,867,077 | 2/1975 | Deprez | 425/405 H |

*Primary Examiner*—J. Howard Flint, Jr.
*Attorney, Agent, or Firm*—Fay & Sharpe

[57] ABSTRACT

Isostatic moulding apparatus comprises a fixed frame assembly comprising an upper bolster, a lower bolster and connecting rods with a clamp cylinder in the lower bolster; a pressure vessel with removable end members is mounted on a support which is pivotably mounted on one of the connecting rods so that the pressure vessel can be swung into the fixed frame assembly to overlie the piston of the clamp cylinder. The pressure vessel and the clamp cylinder are connected to a common source of hydraulic pressure fluid so that application of pressure simultaneously clamps the end members and effects moulding of a compact within the pressure vessel. After the pressure vessel is swung out of the fixed frame, a cylinder is extended to move a trolley down cam tracks to lower the bottom end member of the pressure vessel so that the compact can be removed therefrom. After the bottom end member has been raised again the top end member can be removed to allow a further charge of powder to be loaded into the pressure vessel for a further cycle of operation.

15 Claims, 10 Drawing Figures

MOULDING APPARATUS FOR COMPACTING POWDERED MATERIALS

The invention relates to apparatus for isostatically pressing powdered or granulated materials into 'compacts'.

Typical compacted shapes include—rods, tubes, billets, closed end tubes, tapered and stepped tubes, nozzles, hollow sections internally threaded and splined tubes and balls. Such articles can be used in a wide range of industries, for example ceramic, refractory, chemical, electronic and automotive.

Isostatic pressing is now an established method of producing compacts, which compacts can subsequently be machined and then fired, or fired and then machined or in some cases just fired and require no machining. The main advantages of isostatic pressing are: elimination of a drying stage normally required following extrusion and wet moulding techniques, low distortion on firing due to an even pressed density and finally but probably most important the ability to produce compacts with a high length to diameter ratio and/or thin walls or sections.

Many patents exist for isostatic presses and tooling ranging from very simple wet bag tooling to complex multi-cavity automatic dry bag presses.

The invention utilises a relatively simple 'dry bag' press which is particularly suitable for laboratory or batch production work where tens to hundreds of compacts per day are required rather than thousands of products by fully automatic systems. The press is extremely adaptable and most known compacts can be produced with suitable tooling.

According to the invention there is provided moulding apparatus for compacting powdered materials into desired shapes comprising a fixed press frame with spaced apart members one of which incorporates a clamping cylinder with a short stroke and an isostatic moulding pressure vessel pivotably movable between an operating position in which the pressure vessel lies between said spaced apart members and can be acted on by the clamping cylinder and an ejecting and filling position in which the pressure vessel is not located between said spaced apart members and in which at least one end of the pressure vessel can be removed to allow removal of a compact therefrom and filling of powdered material thereinto.

The clamp and pressure vessel can preferably be simultaneously pressurised from a common source of hydraulic pressure. The main advantages are threefold; firstly the reduction of pumping equipment (one as against two pumps normally), secondly simpler sequencing thus reducing valve circuit complexity and cycle time, and thirdly reduced frame loading since the frame need only be loaded by the clamp cylinder with the force required to balance the pressure developed in the pressure vessel. Existing systems usually have the clamp load setting fixed somewhere near the maximum capacity of the press. In the apparatus of the invention a clamping force just in excess of the theoretical requirement is applied automatically. Thus if only a low isostatic pressure is required only a low clamping force will be applied giving a much longer life to many of the load bearing parts.

To achieve this method of working, the clamping cylinder piston preferably has an area equal to or only slightly larger than the unrestrained projected area of the pressure vessel. Preferably fixed, outer tooling of the pressure vessel is restrained by large fixed retainers and interchangeable tooling of the pressure vessel is restrained, in the operating position, by the clamping cylinder and the press frame.

The invention is diagrammatically illustrated by way of example in the accompanying drawings, in which.

Figure 2:
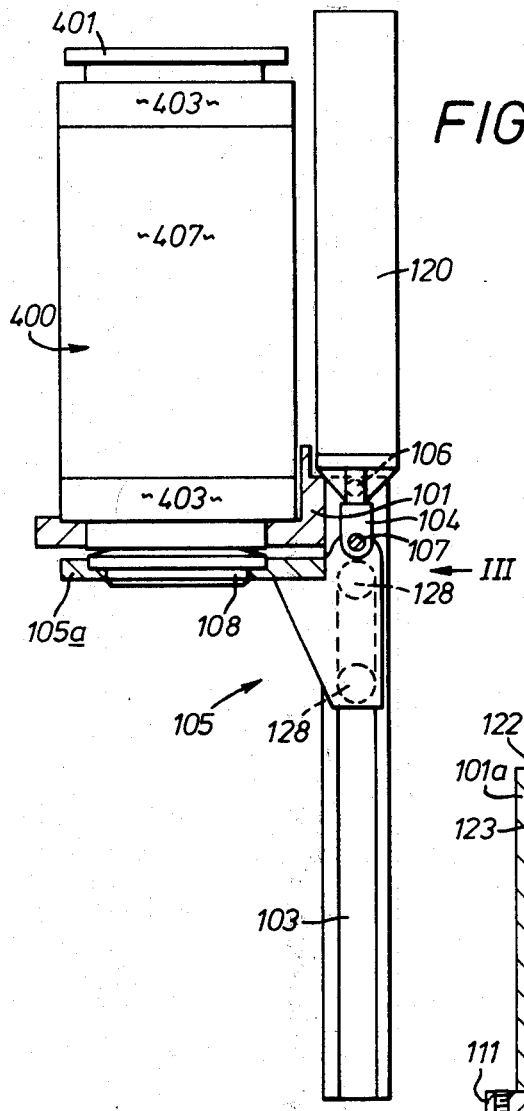
FIG. 2 is a side elevation of an ejector and carrier assembly of moulding apparatus according to the invention.
Figure 3:
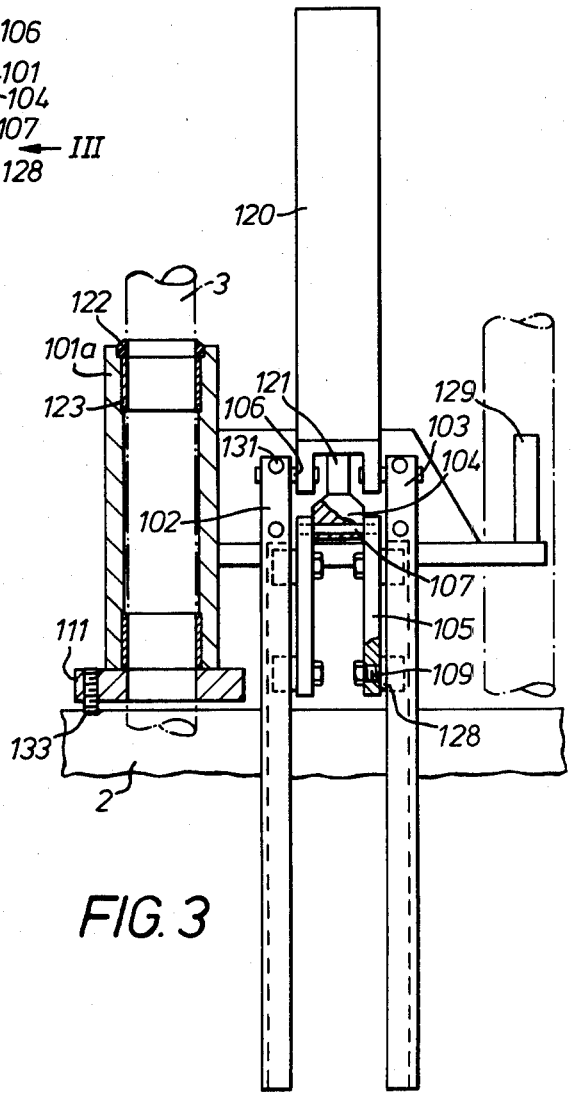
FIG. 3 is a partly sectional view taken in the direction of arrow III of FIG. 2.
Figure 7:
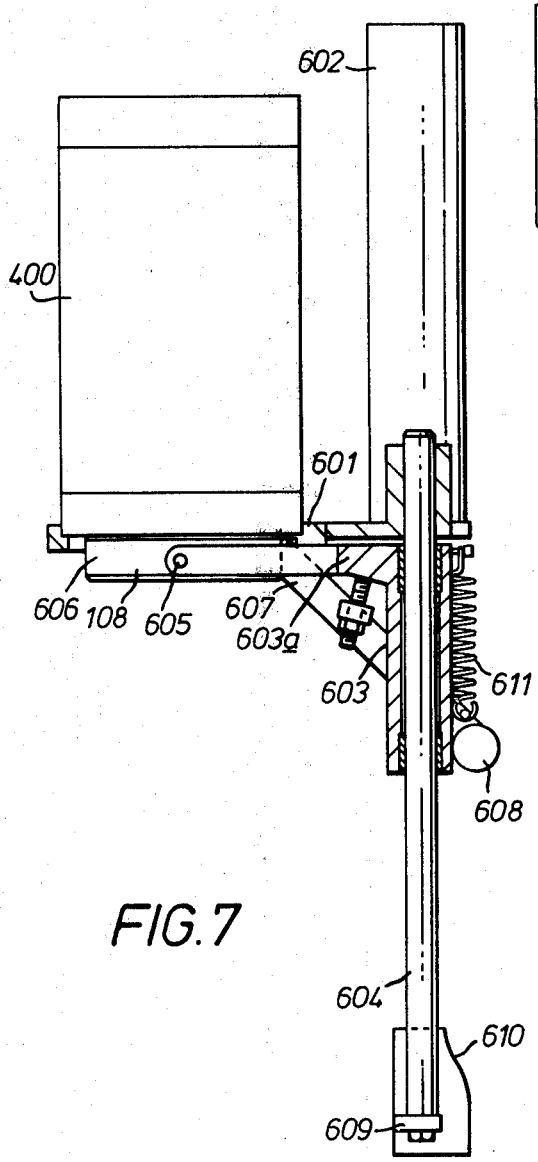
Figure 8:
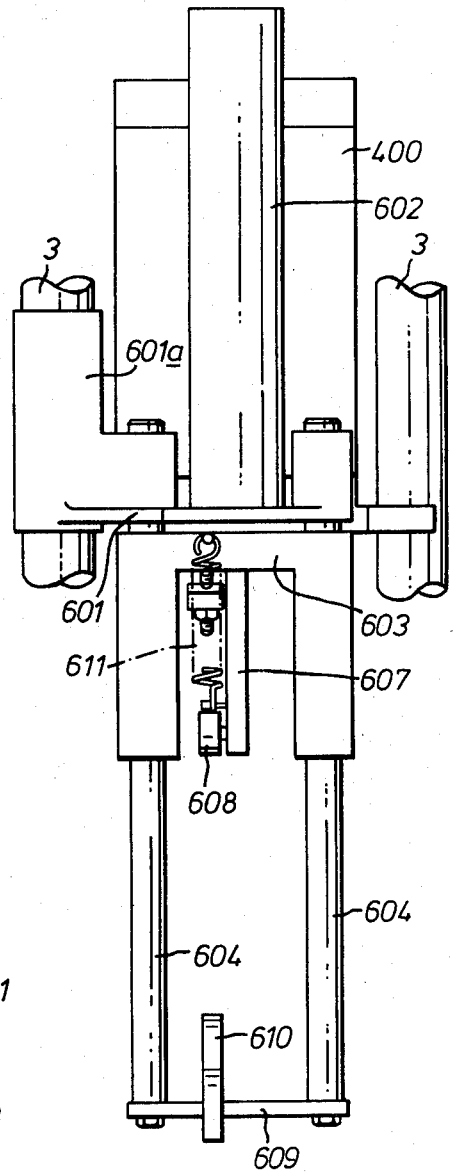
Figure 9:
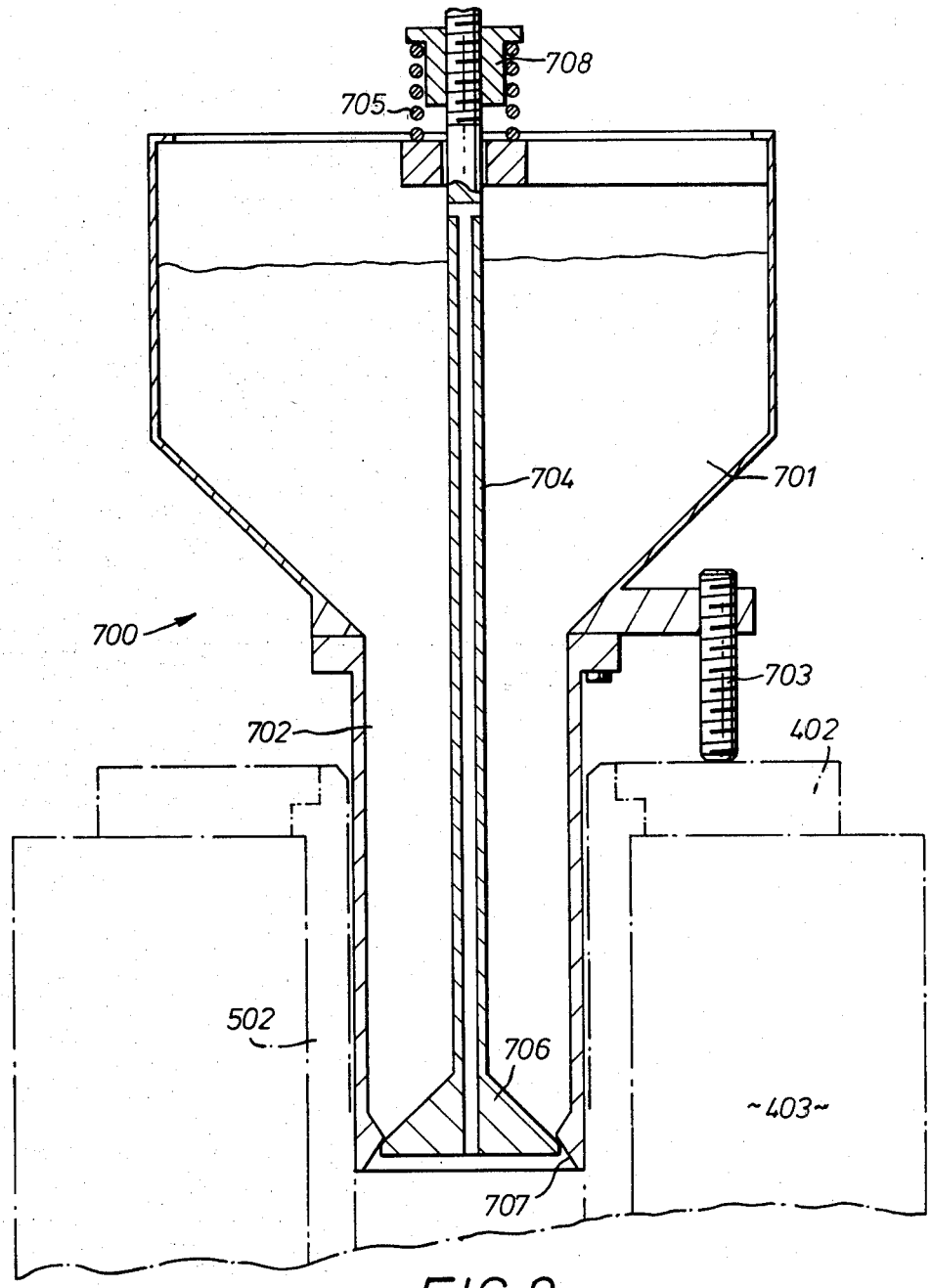
Figure 10:
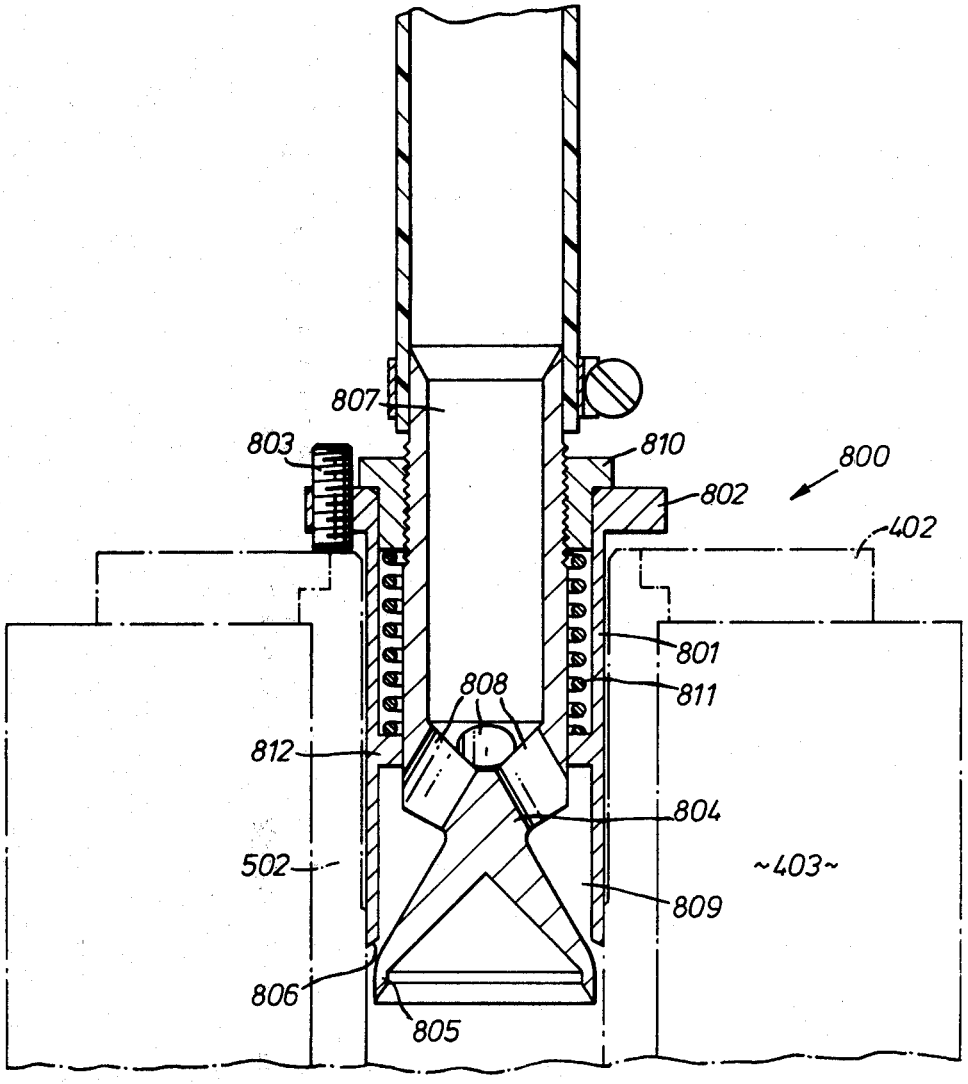

FIGS. 7 and 8 are views similar to FIGS. 2 and 3, of an alternative embodiment of ejector and carrier assembly of moulding apparatus according to the invention; and FIGS. 9 and 10 show two embodiments of powder dispenser for filling powder into the mould cavity of moulding apparatus according to the invention.

Figure 1:
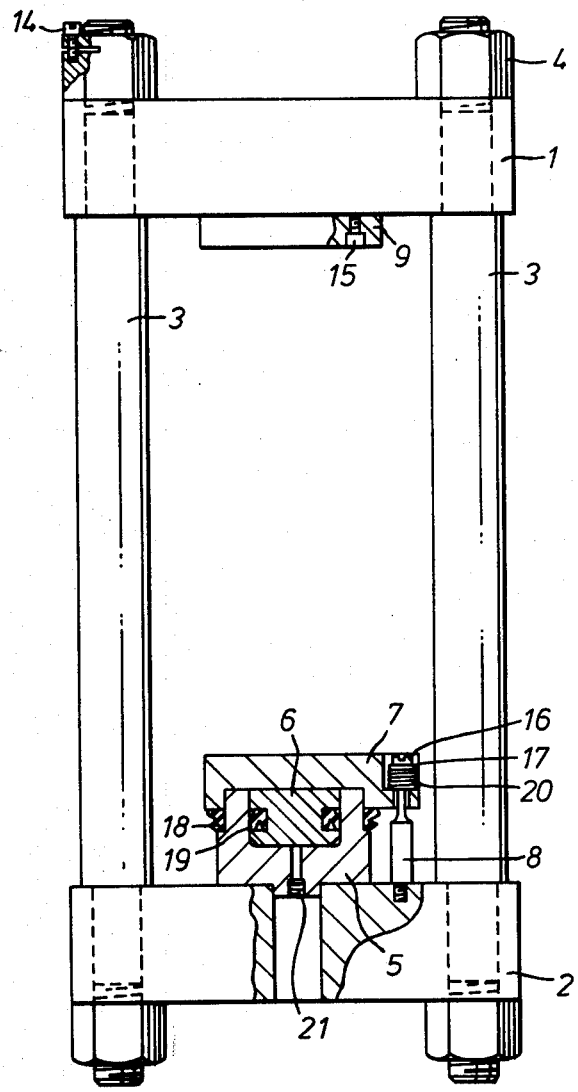
FIG. 1 is a partly sectional elevation of a frame and clamp assembly of moulding apparatus according to the invention.

Referring to FIG. 1, a two column press has a fixed frame assembly comprising a top bolster 1 and a bottom bolster 2 connected by two columns 3 clamped to the bolsters 1 and 2 by means of nuts 4. Each nut 4 is prevented from slackening by a pinch screw 14 acting on a thin section of the nut 4. Located by means of a spigot in the bottom bolster 2, equidistant between the two columns 1, is a clamp cylinder 5 into which is fitted a piston 6. The piston 6 has a high pressure flexible seal 19 fitted therein. Extending across the top of the piston 6 and cylinder 5 is a clamp plate 7 which is radially located by the cylinder 5. Holding the clamp plate 7 against the cylinder 5 are four sets of return spring assemblies each comprising a pillar 8 with its lower end threaded into the bottom bolster 2 and with its upper end projecting through the clamp plate 7. Disc springs 20 are located by the pillar 8 and are preloaded against the clamp plate 7 by a screw 16 acting through a washer 17. Ingress of powder into the clamp assembly is prevented by a proprietory 'V-ring' seal 18 of a kind normally used for rotating applications but in this case having sufficient flexibility to absorb the axial movement involved. In the bottom of the cylinder 5 is a high pressure fluid port 21 connected to a hydraulic pressurisation system. An abutment pad 9 is secured by bolts 15 to the underside of the top bolster 1.

FIGS. 2 and 3 show the arrangement of an ejector and carrier assembly 100 which has two main functions. The first function is to support and guide a pressure vessel and tooling assembly 400 shown in FIG. 5 whilst it is indexed in and out of the frame assembly of FIG. 1. The second function is to provide a means of retracting or unloading a punch and/or mandrel of the assembly 400 to enable a pressed compact to be removed via the bottom of the pressure vessel. The whole assembly 100 is mounted on one of the columns 3 of the press frame which acts as a fixed axle. A carrier bracket 101 has a sleeve 101*a*, into which are fitted two plain bearings 123, located on the column 3, whereby the bracket 101 can be pivoted about the column 3 and can be moved axially thereon. A seal 122 prevents powder ingress into the bearings 123. Axial setting is provided by three adjusting screws 133 fitted into a support collar 111 on the sleeve 101*a*, and acting against the bottom bolster 2. A large circular recess in the bracket 101 locates and supports the pressure vessel assembly 400. Attached to the bracket 101 by means of four bolts 131 are two inwardly facing parallel cam tracks 102, 103 in which run four cam followers 128. The cam followers 128 are connected to a trolley 105 and two of the followers 128 are adjustable by means of eccentric sleeves 109 press-fitted onto shanks of the followers 128 and providing for squareness adjustment of a bracket 105*a* projecting from the trolley 105 and having a circular recess therein to receive and support a bottom punch or mandrel holder 108 relative to the pressure vessel assembly. The trolley 105 and the bracket 105*a* are movable in a vertical direction by means of a fluid power cylinder 120, the piston rod 121 of which is coupled to the trolley 105 by a clevis 104 and a pin 107. The cylinder 120 is mounted on the bracket 101 by two hinge pins 106. The piston 121 in the cylinder 120 can be driven by air or hydraulic fluid. Pivoting movement of the bracket 101 carrying the ejector assembly in and out of the frame assembly can be effected manually, as illustrated, by using a handle 129 or can be effected by a further fluid power cylinder (not illustrated).

Figure 4:
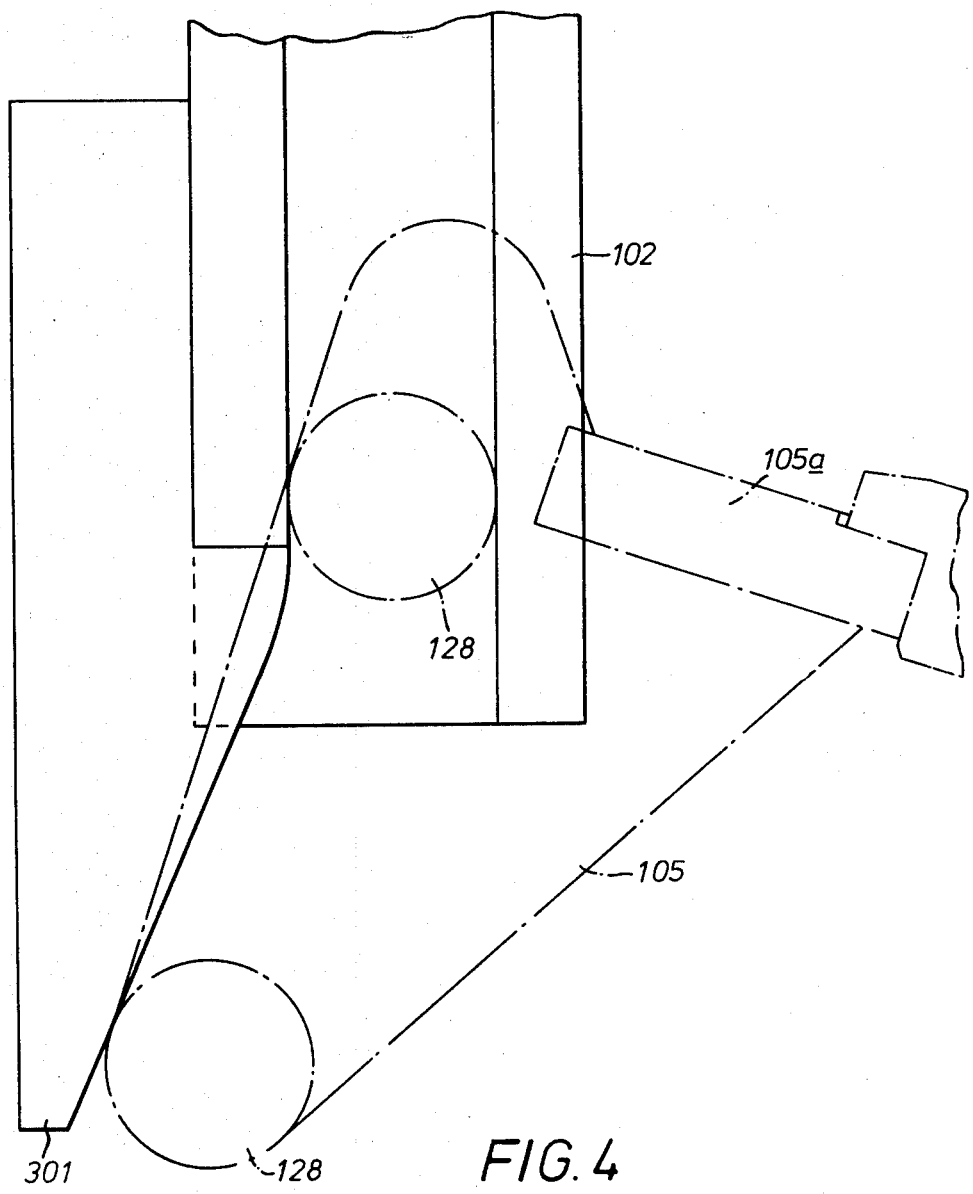
FIG. 4 illustrates a modification of the ejector system of FIG. 3 for compacts required to be removed from a long mandrel.
Figure 5:
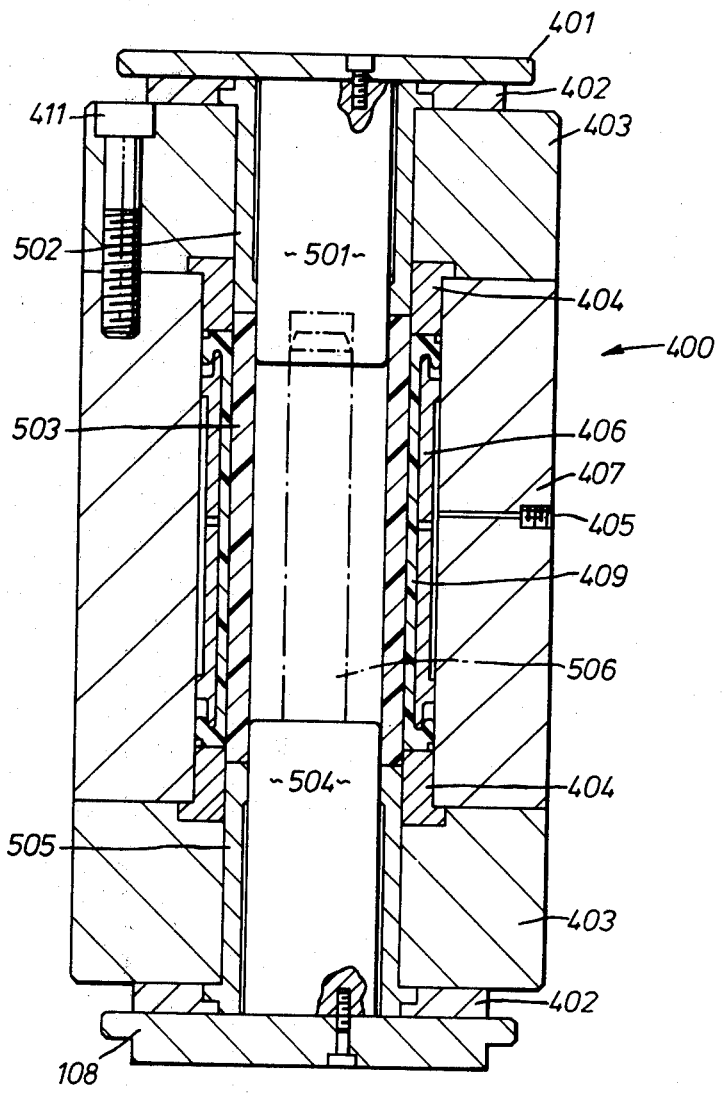
FIG. 5 illustrates a pressure vessel assembly of moulding apparatus according to the invention.
Figure 6:
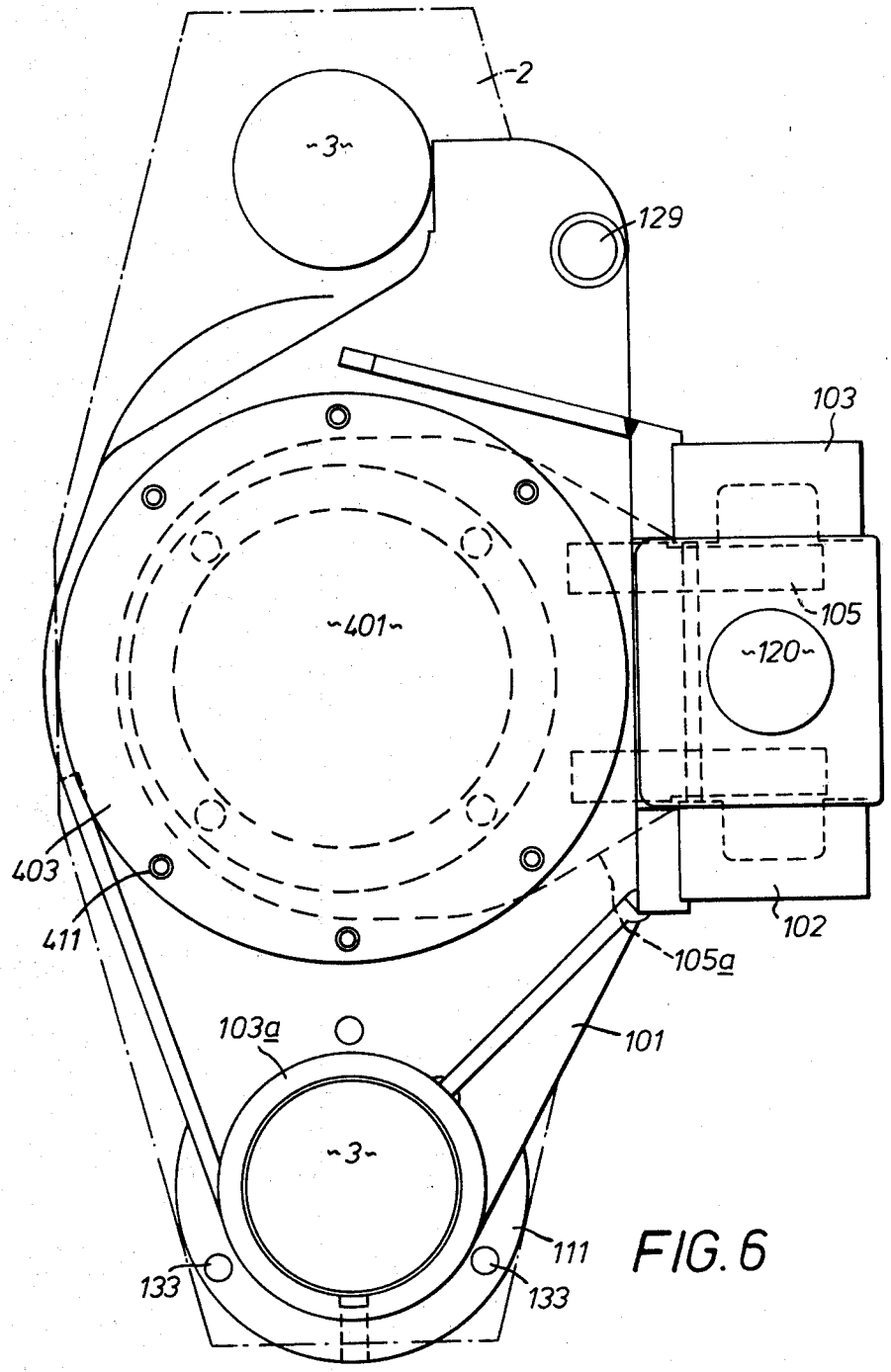
FIG. 6 is a schematic plan view showing the relative dispositions of the frame assembly of FIG. 1, the ejector and carrier assembly of FIGS. 2 and 3 and the pressure vessel of FIG. 5 in the operating position.

FIG. 4 shows that curved extension 301 may be provided at the lower end of each of the cam tracks 102 and 103 to enable the trolley 105 to tilt, when in its fully lowered position, to facilitate removal of a tubular compact from a tooling mandrel 506, FIG. 5.

FIG. 5 shows a typical pressure vessel and tooling assembly 400 comprising a cylindrical vessel 407, with end rings 403 secured by bolts 411 and containing isostatic tooling. The tooling can be divided into two parts, a first part comprising a lantern ring or bag support 406 and a flexible liner or membrane 409 which can be supplied with pressure fluid, by way of flexible hoses or by means of rigid tubing and rotary joints connected to a port 405, and is supported by end rings 404 clamped by the end rings 403. This first part is permanently 'fixed' in the vessel 407 effectively retaining the isostatic (or hydrostatic) fluid in the vessel and forming what is known as a dry bag system. A second part of the tooling comprises an upper punch 501 surrounded by a bush 502, an inner bag or mould 503 within the lantern ring 406 and liner 409, a bottom punch 504 and a bush 505 surrounding the bottom punch 504. This second part of the tooling actually forms the compact and is readily interchangeable with other tooling so that the shape of the compact produced can be readily altered. The interchangeable tooling illustrated produces a solid cylinder or rod. By the addition of the mandrel 506 on the bottom punch 504 a hollow tube could be produced. The top punch 501 has a top punch holder 401 bolted to its outer end and the bottom punch 504 has the bottom punch holder 108 bolted to its lower end. Resilient rings 402 are provided between the top and bottom punch holders 401 and 108 and the end rings 403.

In operation, with the assembly 100 is a swung-out position and with the trolley 205 in the up position locating the bottom punch 504 in the pressure vessel assembly 400, the top punch holder 401 and the top punch 501 are removed.

The cavity formed by the inner bag or mould 503 is then filled with powder either manually or via a dispenser. The top punch holder 401 and top punch 501 are replaced.

By means of the handle 129 the ejector and carrier assembly 100 of FIGS. 2 and 3 and the pressure vessel and tooling assembly of FIG. 4 are pivoted about the column 3 to engage the bottom punch holder 108 of the assembly 400 above the clamp plate 7 of the press frame assembly and the top punch holder 401 of the assembly 400 beneath the abutment pad 9 on the underside of the top bolster 1 of the press frame assembly.

Hydraulic pressure fluid is then supplied from a common source to the port 5 of the clamp assembly and to the port 405 of the assembly 400 pressurising the clamp and vessel simultaneously. This can be accomplished by a direct pumping system or via an intensifier. After a dwell period the pressure is removed. The assemblies 100 and 400 are then swung out from the press frame and cylinder 120 is decompressed to allow the trolley 105 to move downwardly together with the bottom punch 504 with the pressed compact thereon. The compact is removed and the cylinder 120 is acted on to raise the trolley 105 and bottom punch 504 into the pressure vessel assembly 400. The apparatus is then ready for the sequence of operations to be repeated to form a further compact. If the cam track extension 301 is fitted, the trolley 105 together with the bottom punch 504 will tilt at the bottom end of the downward stroke of the piston 121 of the cylinder 120 allowing the compact to be removed from the mandrel 506 by sliding it alongside the pressure vessel assembly 400, thus reducing considerably the length of ejection stroke necessary and thus the time to eject.

In the embodiment of FIGS. 7 and 8 an assembly 600 has a bracket 601 pivotally mounted by a sleeve 601*a* on one of the rods 3 of the press frame. The bracket 601 mounts the pressure vessel 400 and also mounts a cylinder 602. The trolley and cam tracks of the embodiment of FIGS. 2 and 3 are replaced by a slide 603 movable on fixed rods 604. The cylinder 602 has its piston rod coupled to the slide 603 and the slide has a projecting portion 603*a* formed by two spaced apart arms mounting trunnions 605 of a ring 606. The ring 606 receives and supports the bottom punch holder 108 of the pressure vessel assembly 400.

An arm 607 is secured to the ring 606 and mounts a roller 608 at its free end which extends between the fixed rods 604. A transverse beam 609 at the lower end of the rods 604 mounts a cam 610. At the bottom end of the downward movement of the slide 603 the roller 608 abuts the cam 610 and causes the ring 606 together with the bottom punch 504 and the mandrel 506 to tilt and thereby pivot the mandrel 506 out of a vertical position to allow the tubular compact formed to be slid-off the mandrel 506. After an initial upward movement of the slide 603 from its lowermost position to clear the roller 608 from the cam 610, a coil spring 611 tilts the ring 606 back to a horizontal position.

If desired two pressure vessels can be associated with a single press frame and hydraulic power source and be brought alternately into co-operation with the press frame such that a moulding operation can be effected in one pressure vessel while the other pressure vessel is being unloaded and recharged with moulding powder.

The cylinder 120 or 600 can be used to vibrate the mandrel 506 or bottom punch 504 by fast reversal of a valve controlling supply of fluid thereto. This assists powder distribution during loading of power into the pressure vessel. The interchangeable tooling may include several small diameter cavities whereby a plurality of small diameter compacts may be formed simultaneously.

Referring to FIG. 9, a powder dispenser 700 is shown in a closed position comprising a hopper 701 with a dispensing tube 702 engaged in the open upper end of the pressure vessel of FIG. 5. Adjustable stop screws 703 (only one is shown) have their lower ends engaged in the filling position shown with the resilient ring 402 of the pressure vessel. A valve stem 704, is biassed for upward movement by a compression spring 705, and has a valve 706 at its lower end co-operating with a valve seat 707 in the tube 702. Downward pressure applied to the stem 704 will open the valve 706 and allow powder to fill from the hopper 701 into the mould cavity. A stop 708 limits downward movement of the stem 704. When the mould cavity is full, the powder filled thereinto will stop the flow of further powder out of the hopper. As soon as the hopper 701 is raised to withdraw it the spring 705 will close the valve 706. The downward movement of the valve stem 704 can be applied manually or mechanically and the hopper 701 could be replaced by a remote hopper, the tube 702 then being a flexible tube.

The dispenser 800 of FIG. 10 is shown in the open position. A dispenser tube 801 has a shoulder ring 802 at its upper end mounting stop screws 803 and a valve member 804 is mounted within the tube 801 and has a lower end 805 which co-operates with a valve seat 806, formed by the bottom edge of the tube 801, in the closed position. Powder is supplied through the bore 807 of the valve member 804 and passes through ports 808 into a compartment 809 above the lower end 805. A stop ring 810 is adjustably mounted by a screw thread on the tube 801. A compression spring 811 extends between the stop ring 810 and a projecting ring 812 secured in the bore of the tube 801. Downward movement of the tube 801 into the pressure vessel will be stopped by the stop screws 803 abutting the resilient ring 402 and continued downward movement of the valve member 804 will compress the spring 811 and open the valve 805, 806. Powder will flow until the mould cavity is full. Upward movement of the dispenser will allow the spring 811 to close the valve 805, 806 automatically.

In the dispensers 700 and 800 the cavity itself is used to measure the correct volume of powder. When the cavity is full the powder stops flowing and as the dispenser is withdrawn the valve is closed or closes thus stopping any further powder entering the cavity. For a given fill opening diameter various volumes and powders can be dispensed requiring only minor adjustment of either filling speed or height of fill. The dispenser 800 opens and closes itself automatically as the probe is pushed home and then withdrawn on filling.

What is claimed is:

1. Moulding apparatus for compacting powdered materials into desired shapes comprising a fixed press frame two opposite side of which are formed by a pair of spaced apart members, a clamping cylinder mounted on one of said members, an isostatic moulding pressure vessel with a removable end member and means pivotably mounting said pressure vessel for movement between an operating position in which said pressure vessel lies between said spaced apart members and can be acted on by said clamping cylinder and an ejecting and filling position in which said pressure vessel is not located between said spaced apart members and in which said removable end member of said pressure vessel can be removed to allow removal of a moulded compact from said pressure vessel and filling of powdered material into said pressure vessel to form a further compact.

2. Moulding apparatus as claimed in claim 1, wherein said clamping cylinder and said pressure vessel are connected to a common source of hydraulic pressure.

3. Moulding apparatus as claimed in claim 2, wherein said clamping cylinder has a piston with an area equal to or slightly larger than the unrestrained projected area of said pressure vessel.

4. Moulding apparatus as claimed in claim 1, wherein said pressure vessel has fixed, outer tooling restrained by large fixed retainers and interchangeable tooling restrained, in the operating position, by said clamping cylinder and said press frame.

5. Moulding apparatus as claimed in claim 4, further comprising ejection means to remove a compact from said pressure vessel after isostatic moulding thereof, said ejection means comprising support means for said interchangeable tooling at the lower end of said pressure vessel, guide means to guide said support means for movement generally vertically with respect to said press frame and a fluid power cylinder to cause said support means to move on said guide means.

6. Moulding apparatus as claimed in claim 5, wherein said guide means comprises a pair of cam tracks and a trolley mounting cam followers and movable on said cam tracks.

7. Moulding apparatus as claimed in claim 6, wherein said cam tracks at the lower end thereof have a curved section to cause tilting of said interchangeable tooling at the lower extremity of movement of said support means to facilitate removal of a compact from said interchangeable tooling.

8. Moulding apparatus as claimed in claim 5, wherein said guide means comprises a pair of rods and a slider movable thereon.

9. Moulding apparatus as claimed in claim 8, wherein said support means includes a first part rigid with said slider and a second part which engages said interchangeable tooling and is connected to said first part by a pivot with a horizontal axis, and said second part includes a projection to engage a fixed stop at the lower extremity of movement of said slider to cause pivoting of said second part of said support means and said interchangeable tooling about said horizontal axis to facilitate removal of said compact from said interchangeable tooling.

10. Moulding apparatus as claimed in claim 9, further comprising return spring means biassing said second part for movement to a position in which said interchangeable tooling is in a vertical orientation.

11. Moulding apparatus as claimed in claim 1, wherein said press frame includes rods coupling said spaced apart members and in which one of said rods forms a fixed axle of said means pivotably mounting said pressure vessel.

12. Moulding apparatus as claimed in claim 11, further comprising adjustment means for adjusting the vertical position of said pressure vessel with respect to said press frame.

13. Moulding apparatus as claimed in claim 12, wherein said adjustment means comprises a collar surrounding said one of said rods and forming an axial bearing for a sleeve of said support means, and jacking screws to adjust the height of said collar.

14. Moulding apparatus as claimed in claim 6, wherein said cam followers are mounted on said trolley by eccentric bearings such that by adjustment of said eccentric bearings the inclination of said trolley with respect to said cam tracks can be adjusted.

15. Moulding apparatus as claimed in claim 1, wherein said clamping cylinder is secured against ingress of moulding powder by a 'V-ring' seal of the kind usually used for rotating applications.

* * * * *